US008149153B1

(12) United States Patent
Wieneke et al.

(10) Patent No.: US 8,149,153 B1
(45) Date of Patent: Apr. 3, 2012

(54) INSTRUMENTATION STRUCTURE WITH REDUCED ELECTROMAGNETIC RADIATION REFLECTIVITY OR INTERFERENCE CHARACTERISTICS

(75) Inventors: Garry Wieneke, Jasper, IN (US); Ameer Beitvashahi, Bloomington, IN (US); Dent Matthew, Orlean, IN (US); Gerry Miller, Bedford, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 907 days.

(21) Appl. No.: 12/172,216

(22) Filed: Jul. 12, 2008

(51) Int. Cl.
*H01Q 17/00* (2006.01)

(52) U.S. Cl. ..... 342/1; 342/4

(58) Field of Classification Search ..... 342/1–4
See application file for complete search history.

(56) References Cited

U.S. PATENT DOCUMENTS

| | | | | |
|---|---|---|---|---|
| 2,996,709 | A | 8/1961 | Pratt | |
| 2,996,710 | A | 9/1961 | Pratt | |
| 3,754,255 | A | 8/1973 | Suetake | |
| 3,836,967 | A | 9/1974 | Wright | |
| 4,173,018 | A | 10/1979 | Dawson | |
| 4,833,485 | A | 5/1989 | Morgan | |
| 4,924,228 | A | 5/1990 | Novak | |
| 5,128,678 | A | 7/1992 | Novak | |
| 5,173,699 | A | 12/1992 | Barr | |
| 5,276,447 | A | 1/1994 | Shingo | |
| 5,436,630 | A | 7/1995 | Nash | |
| 5,717,397 | A | 2/1998 | Ruszkowski, Jr. | |
| 6,060,411 | A | 5/2000 | Cline | |
| 6,456,224 | B1 * | 9/2002 | Cobb et al. | 342/2 |
| 6,661,368 | B1 * | 12/2003 | Allen et al. | 342/25 R |
| 6,771,205 | B1 * | 8/2004 | Barton et al. | 342/13 |
| 7,170,467 | B1 | 1/2007 | Town | |
| 7,205,928 | B1 * | 4/2007 | Sweet | 342/26 B |
| 7,834,799 | B1 * | 11/2010 | Wells | 342/1 |
| 2004/0112403 | A1 * | 6/2004 | Lewis et al. | 134/1 |
| 2004/0233116 | A1 * | 11/2004 | Desargant et al. | 343/757 |
| 2007/0107370 | A1 * | 5/2007 | Douglas | 52/741.3 |
| 2008/0007444 | A1 * | 1/2008 | Martinson et al. | 342/20 |

* cited by examiner

*Primary Examiner* — Timothy A Brainard
(74) *Attorney, Agent, or Firm* — Christopher A. Monsey

(57) ABSTRACT

An instrumentation structure includes a sensor array and a support structure. The sensor array is rotatable around multiple axes. Radar absorbent material (RAM) is adapted to conform to non-planar exterior surfaces of the instrumentation structure.

49 Claims, 7 Drawing Sheets

INSTRUMENTATION STRUCTURE WITH REDUCED ELECTROMAGNETIC RADIATION REFLECTIVITY OR INTERFERENCE CHARACTERISTICS

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

BACKGROUND OF THE INVENTION

The invention relates to instrumentation structures with reduced electromagnetic radiation interference and interference characteristics.

Instrumentation structures may house sensors, such as optical devices. The optical devices may include, for example, infrared cameras, visible light cameras, laser range finders, etc. A instrumentation structure in accordance with the invention may used in a variety of settings including, for example, security systems, aircraft, watercraft, land vehicles, and stationary structures. The user may be, for example, a commercial, governmental, or private entity. The user may desire that the instrumentation structure be compatible with airborne or ground based radar or other electromagnetic radiation transmitters or receivers. Significant advantages are associated with enabling use of instrument systems which mitigate signal returns from the instrumentation structure or interference with radio frequency systems or system operators which receive undesirable radar returns off the instrumentation structure. For example, an instrumentation structure in accordance with the invention can reduce clutter or interference on an air traffic control system which could distract an air traffic controller in controlling aircraft viewed on a radar screen.

SUMMARY OF THE INVENTION

One aspect of the invention is an instrumentation structure having radar absorbent material (RAM) fixed thereon.

BRIEF DESCRIPTION OF THE DRAWING

In the drawings, which are not necessarily to scale, like or corresponding parts are denoted by like or corresponding reference numerals.

DETAILED DESCRIPTION OF THE PREFERRED EMBODIMENTS

Figure 1A:
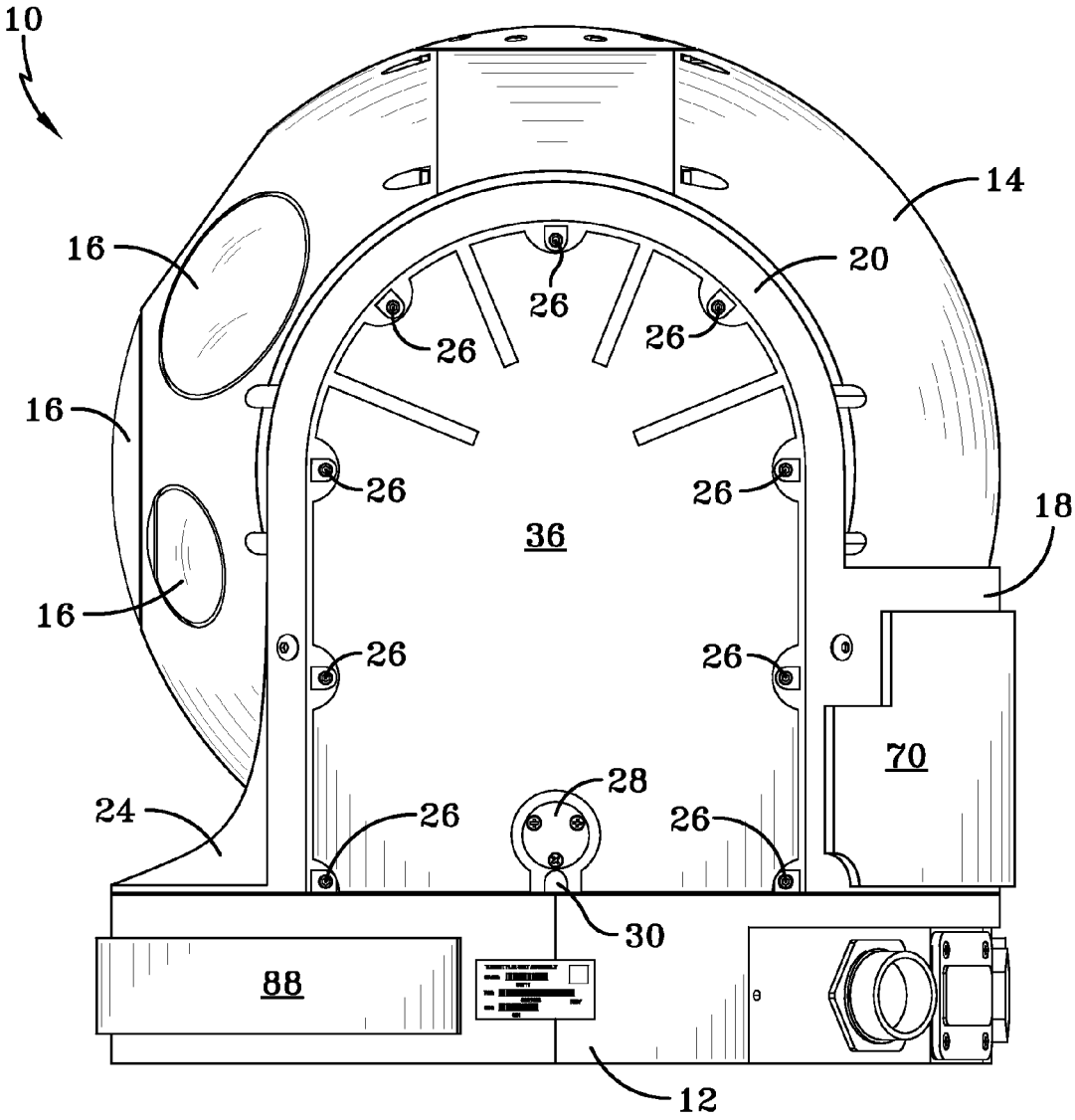
FIGS. 1A, 1B, and 1C are elevations views of one embodiment of an instrumentation structure in accordance with the invention.
Figure 1B:
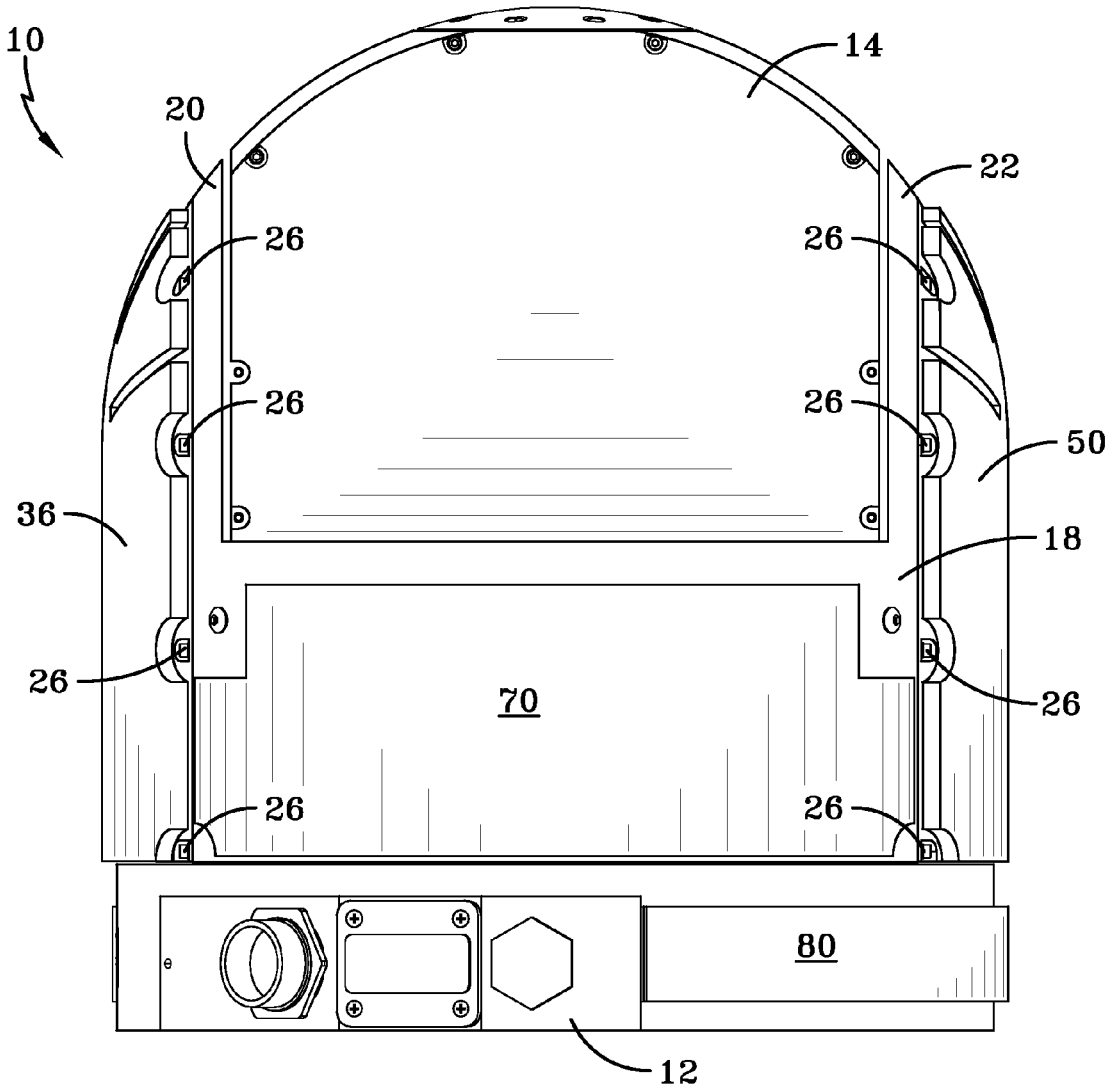
Figure 1C:
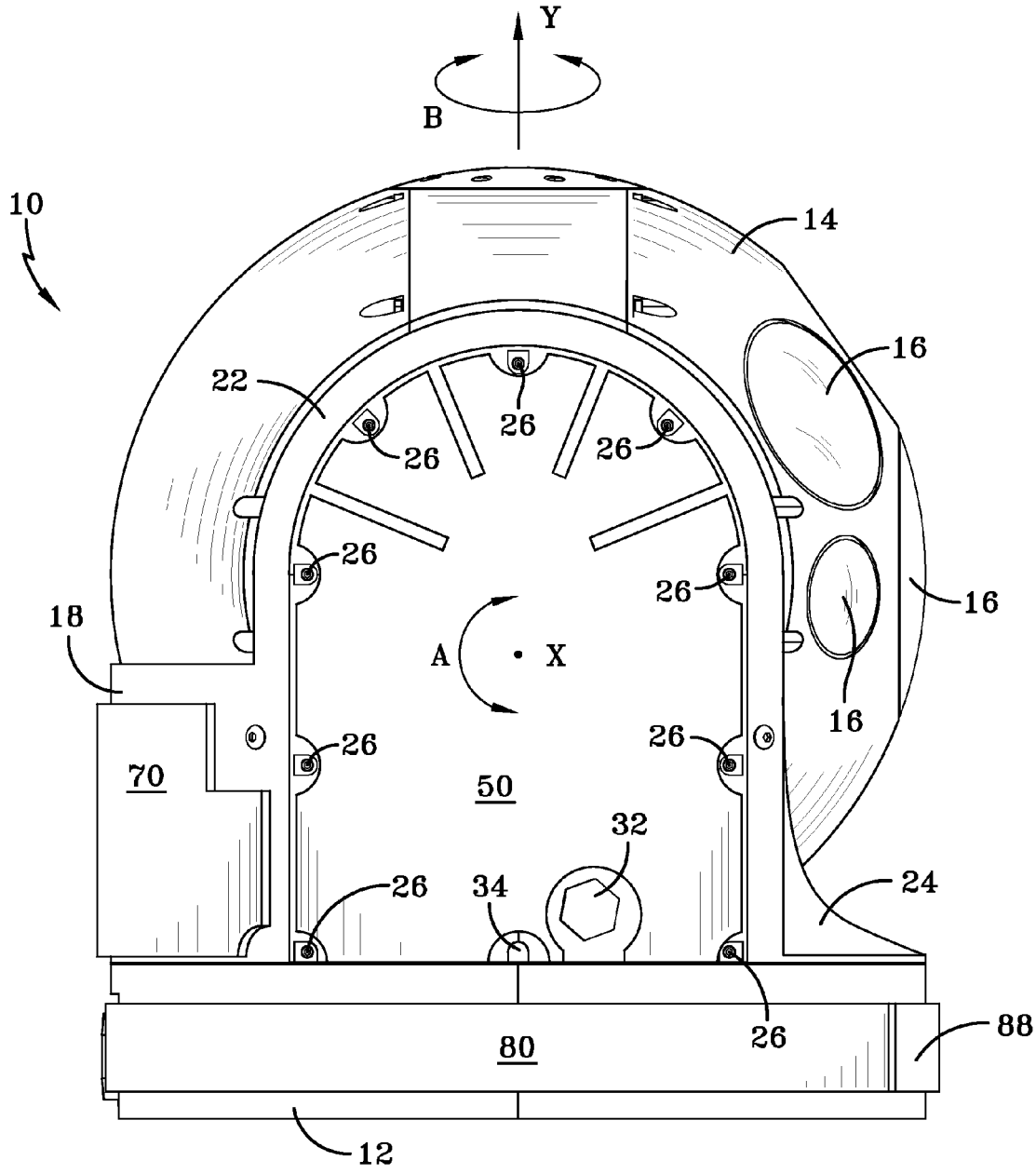

FIGS. 1A, 1B, and 1C are elevations views of one embodiment of an instrumentation structure 10 in accordance with the invention. Instrumentation structure 10 may include a rotatable sensor array and a supporting structure. It should be noted that a variety of devices may be installed in ball 14 such as laser systems or other non-sensor systems. In FIGS. 1A-C, the rotatable sensor array may comprise a generally spherical ball 14 having one or more lenses 16. Ball 14 may be rotatable 360 degrees around the axis X (FIG. 1C) as shown by arrow A. Ball 14 may also be 360 degrees rotatable around axis Y (FIG. 1C). Axis Y may be perpendicular to axis X.

Supporting structure for instrumentation structure 10 may include a base 12 and a tilt support structure. The tilt support structure may be stationary with respect to rotation of the ball 14 around the X-axis and may rotate with the ball 14 with respect to rotation around the Y-axis. The tilt support structure may include a throat 24 (FIGS. 1A and 1C), a neck 18 (FIG. 1B), and a pair of opposing ears 20, 22 (FIG. 1B) connecting the throat 24 and neck 18. In other words, the throat 24, neck 18 and ears 20, 22 comprise front, back and side sections of the tilt support structure which mount the ball 14. It should be noted that the term "ears" refers to side mounts for the ball 14 structure. Exterior surfaces of the ears 20, 22 may be non-planar. In particular, portions of the exterior surfaces of the ears 20, 22 may be convex.

Figure 2B:
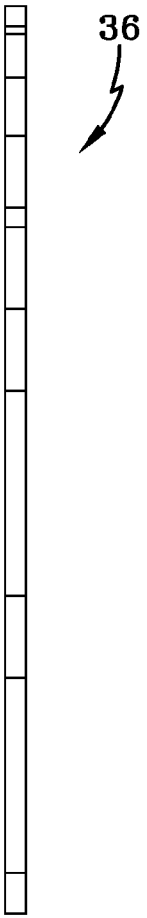
FIGS. 2A and 2B are front and side elevation views, respectively, of a first piece of RAM.
Figure 2A:
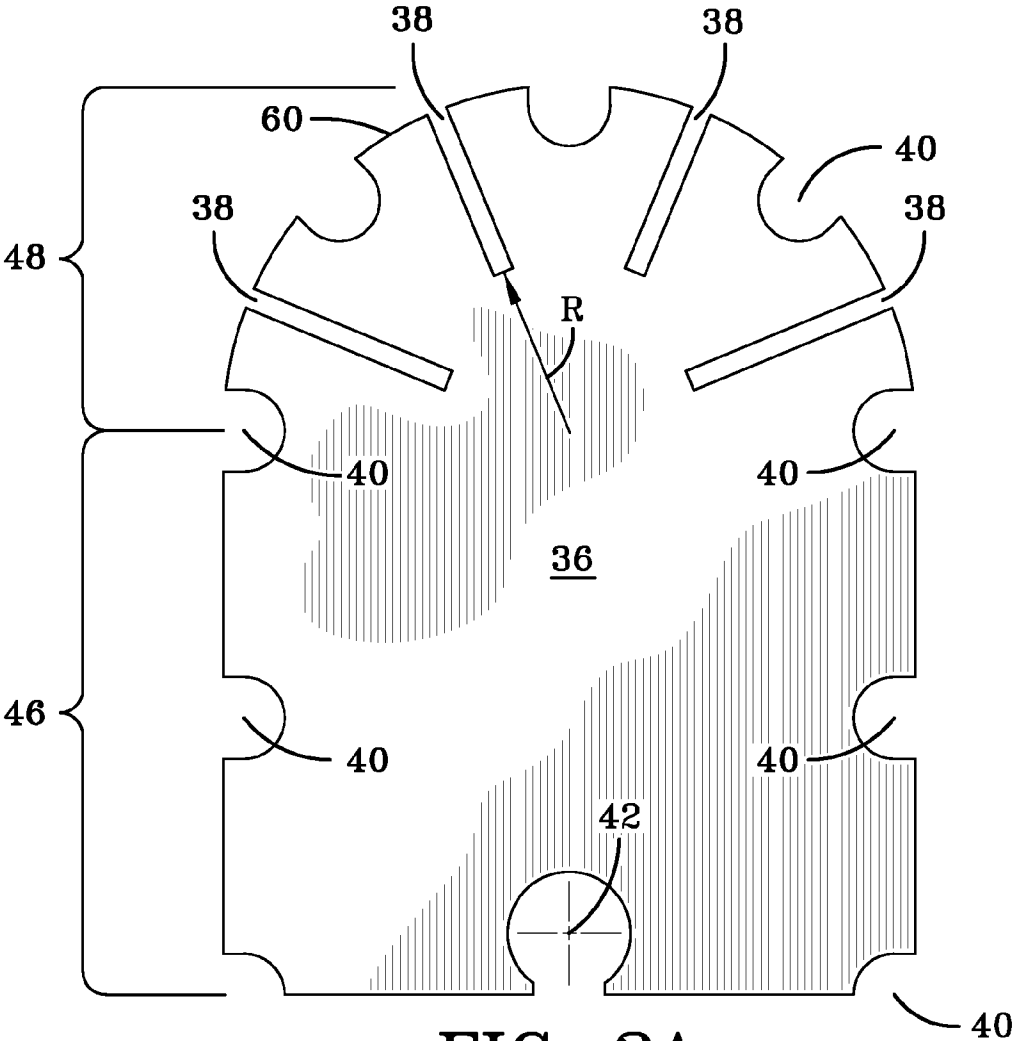
Figure 3B:
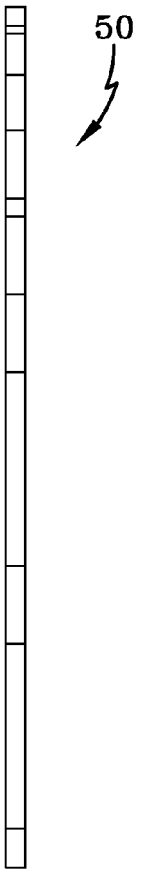
FIGS. 3A and 3B are front and side elevation views, respectively, of a second piece of RAM.
Figure 3A:
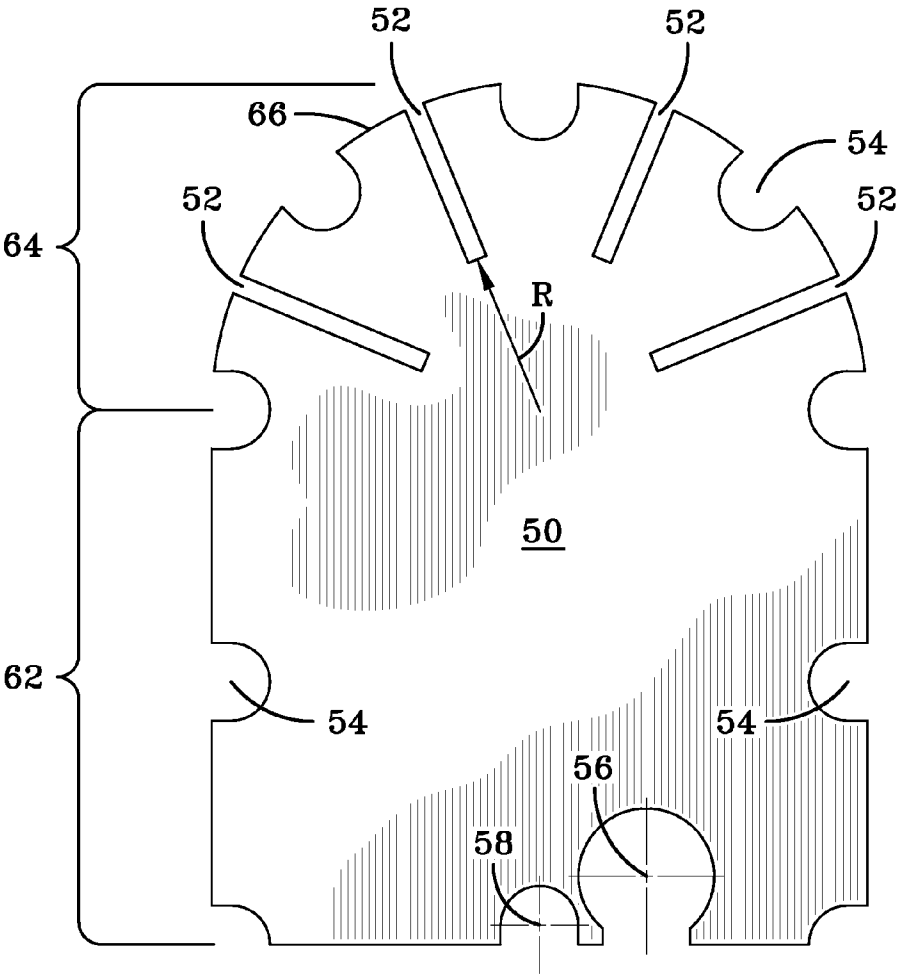

RAM may be fixed to exterior surfaces of the instrumentation structure 10. RAM 36 (FIG. 2A) and RAM 50 (FIG. 3A) may be fixed to exterior surfaces of the ears 20, 22, respectively. The RAM 36 (FIGS. 2A and 2B) may include a generally rectangular portion 46 and a generally semi-circular portion 48. Semi-circular portion 48 may include one or more slots 38 formed therein such that the RAM 36 substantially conforms to the non-planar exterior surfaces of the ear 20. Slots 38 may extend from a peripheral edge 60 of the RAM 36 inwardly along a radius R of semi-circular portion 48. Edges of the RAM 36 within the slots 38 may be caulked. RAM 36 may include notches 40 formed therein to allow access to, for example, fasteners 26 (FIGS. 1A-1C). RAM 36 may include one or more openings 42 for access to, for example, a desiccant cartridge cover 28 and an air access 30 (FIG. 1A).

The RAM 50 (FIGS. 3A and 3B) may include a generally rectangular portion 62 and a generally semi-circular portion 64. Semi-circular portion 64 may include one or more slots 52 formed therein such that the RAM 50 substantially conforms to the non-planar exterior surfaces of the ear 22. Slots 52 may extend from a peripheral edge 66 of the RAM 50 inwardly along a radius R of semi-circular portion 64. Edges of the RAM 50 within the slots 52 may be caulked. RAM 50 may include notches 54 formed therein to allow access to, for example, fasteners 26 (FIGS. 1A-1C). RAM 50 may include one or more openings 56, 58 for access to, for example, a nitrogen input 32 and nitrogen exhaust 34 (FIG. 1C).

Figure 4A:
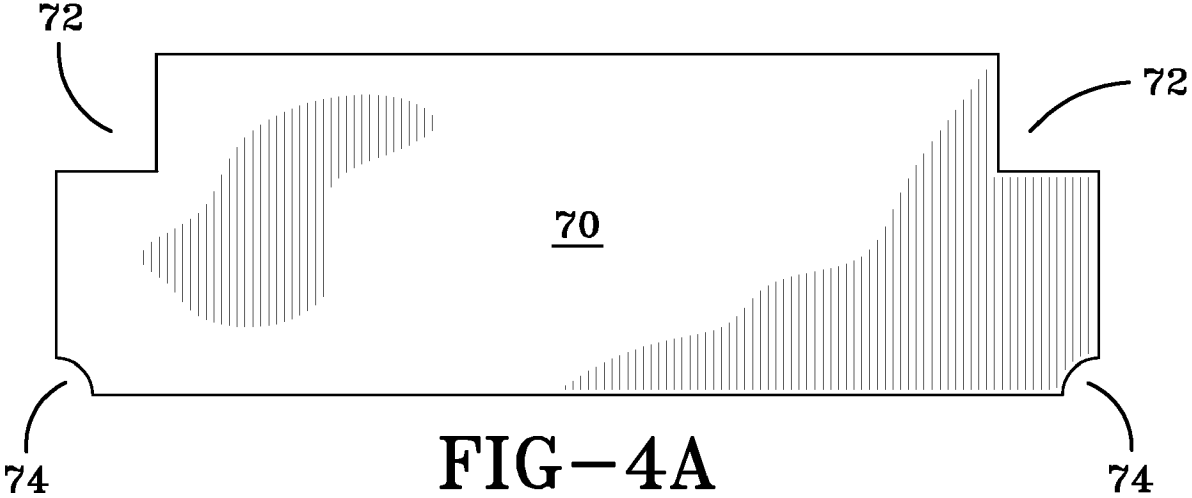
FIGS. 4A and 4B are front and side elevation views, respectively, of a third piece of RAM.
Figure 4B:
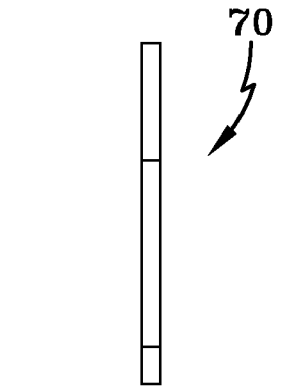

RAM 70 (FIG. 4A) may be fixed to the neck 18 (FIG. 1B) of instrumentation structure 10. RAM 70 may be substantially rectangular. RAM 70 may include one or more substantially rectangular notches 72, or substantially circular notches 74, for access to fasteners or internal components of the instrumentation structure 10.

Figure 5A:
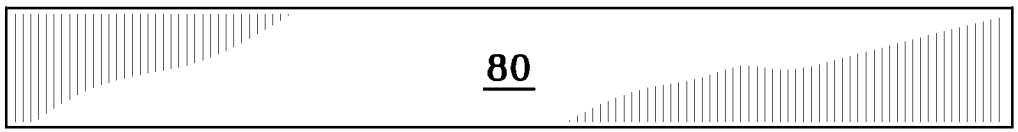
FIGS. 5A and 5B are front and side elevation views, respectively, of a fourth piece of RAM.
Figure 5B:
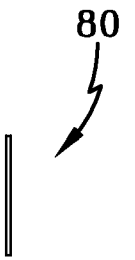
Figure 6A:
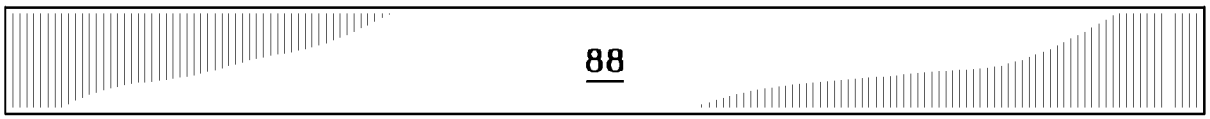
FIGS. 6A and 6B are front and side elevation views, respectively, of a fifth piece of RAM.
Figure 6B:
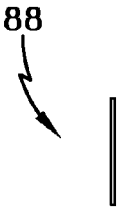

RAM 80 (FIG. 5A) and RAM 88 (FIG. 6A) may be fixed to the base 12 (FIGS. 1A-1C) of instrumentation structure 10. RAM 80 and RAM 88 may comprise substantially rectangular shapes.

Generally, the base 12 of instrumentation structure 10 is fixed to a mounting structure and the ball 14 and ears 20, 22 depend downwardly from the base 12. In this orientation, the base 12 may have a lesser radar cross-section than the remainder of the instrumentation structure 10. Thus, a thickness of the RAM 80, 88 fixed to base 12 may be less than a thickness of the RAM 36, 50, 70 fixed to ears 20, 22 and neck 18. In one embodiment, a thickness of the RAM 80, 88 is about 0.06 inches and a thickness of the RAM 36, 50, 70 is about 0.25 inches.

Figure 7:
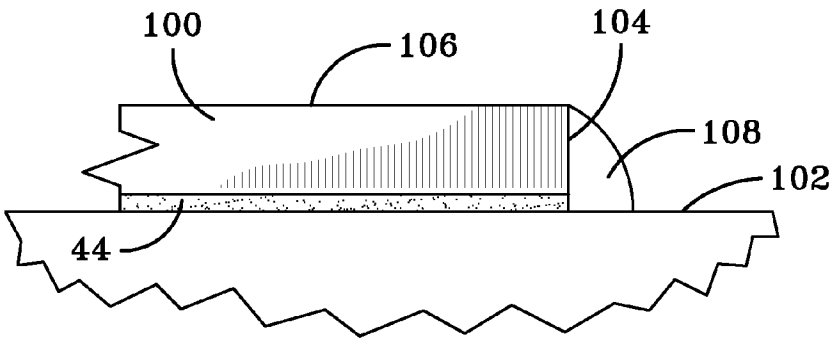
FIG. 7 is a sectional view of an exemplary RAM installation.

FIG. 7 is a sectional view of an exemplary RAM 100 installed on a surface 102 of the instrumentation structure 10. The RAM 100 may comprise a closed cell synthetic rubber, such as neoprene. The RAM 100 may include an adhesive backing 44. Edges 104 of the RAM 100 may be substantially perpendicular to the surface 102 of the RAM 100. Caulk 108 may be applied along the edges 104 of the RAM 100.

Figure 8:
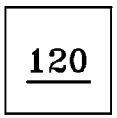
FIG. 8 is a schematic drawing of a water jet cutter.

RAM may be supplied in generally rectangular sheets. The processes of shaping the RAM, forming slots in the RAM, forming notches in the RAM, forming openings in the RAM, etc., may be performed using a water jet cutter 120 (FIG. 8). Ideally, when applying the RAM, one should use the thickest RAM possible. The amount of potential radar absorption is directly proportional to the thickness of the material. The natural state of the RAM is flat. When applied to curved surfaces, the RAM tends to crease. Thinner RAM is easier to fit over a more extremely curved surface.

Alternative embodiments may employ a radar absorbing coating for the ball 14 or other portions of the instrumentation structure which RAM layers are not applied to. Radar absorbing coatings can be composed of vinyl latex paint and carbon nanotube filaments. Finely ground Mylar and neoprene can be added during mixing of the coating. Adding ground carbon to the paint mixture can provide good coverage and results. Some types of electromagnetic energy can be influenced by increasing or reducing the thickness of the coating. Surface preparation is important to prevent delamination or peeling.

RAM sealant or caulking material may have the same carbon nanotube filaments in a vinyl latex caulk base. This thickened substance can contain a finely ground carbon, Mylar and neoprene mix added as a last step before application. Surface preparation again is very important to prevent delamination, pealing or flaking A two part applicator can be used to apply a multi-layered sealant or caulking material but care must be taken to apply the carbon, Mylar and neoprene mix side of the applicator to the metal surface.

References to caulk, caulking material or sealant should be understood to be examples of different methods, design features or structures for use in creating seal or edge terminations or transitions for the RAM materials to the surface which a RAM material is applied to. References to caulk, caulking materials or sealants should be understood to also include a termination or transition structure which is designed as a part of the RAM material edge areas. Thus, caulk, caulking material or structure references should be understood to be a reference to a transition or seam design feature of the RAM or structures which are formed into the RAM seams or edges or access holes or areas through the RAM itself.

While the invention has been described with reference to certain preferred embodiments, numerous changes, alterations, and modifications to the described embodiments are possible without departing from the spirit and scope of the invention as defined in the appended claims, and equivalents thereof.

What is claimed is:

1. An apparatus, comprising:

an instrumentation structure including a sensor array and a supporting structure, the sensor array having multi-axis rotatability; and RAM applied to at least one or more exterior surfaces of the instrumentation structure and adapted to reduce electromagnetic radiation reflectivity or detection characteristics including radar visibility of the instrumentation structure, the exterior surfaces of the instrumentation structure including non-planar surfaces and fasteners wherein the RAM is adapted to conform to curvatures of the non-planar surfaces and allow access to the fasteners such that said RAM maintains an approximate smooth surface in areas where said RAM is conformed to said non-planar surfaces;

wherein the supporting structure includes a base, and a tilt support structure that is stationary with respect to rotation of the sensor array around a first axis, and rotates with the sensor array with respect to rotation around a second axis that is perpendicular to the first axis, the RAM being fixed to exterior surfaces of the tilt support structure;

wherein the tilt support structure includes a throat, a neck, and a pair of opposing ears connecting the throat and neck, the RAM being fixed to exterior surfaces of the ears.

2. The apparatus of claim 1, wherein the RAM material has a first and second thickness, said RAM having said first thickness is applied on one part of the instrumentation structure and said RAM having said second thickness is applied on another part of the instrumentation structure.

3. The apparatus of claim 2, wherein said RAM has a third tapering thickness around service access portions, instrumentation portions and fastener portions of said instrumentation structure.

4. The apparatus of claim 1, wherein a RAM coating is applied to at least one or more areas of said instrumentation structure which does not have said RAM applied thereto.

5. The apparatus of claim 1, wherein a sealing material is applied to at least one or more edge portions of said RAM, said edge portions may include seams in said RAM or discontinuous edges of said RAM material which do not abut another edge of said RAM.

6. The apparatus of claim 5, wherein said sealing material comprises a multi-layered caulking material which is adapted to be dispensed in a semi-liquid form such that it smoothly conforms to edges of said RAM material and seals edges or seams of said RAM such that said edges or seams are sealed against water or wind slip stream intrusion.

7. The apparatus of claim 6, wherein said multi-layered caulking material has electromagnetic radiation absorptive or deflecting characteristics.

8. The apparatus of claim 1, wherein said RAM thickness is selected based on a plurality of characteristics of said RAM including surface contours of said instrumentation structure including curvature of said instrumentation structure and flexibility of said RAM.

9. The apparatus of claim 1, wherein said RAM comprises a sheet of RAM material wherein one side of said RAM material conformed to at least one portion of said curvatures of said non-planar surfaces comprises one or more slots where RAM material has been removed, said RAM material at said slots are pressed together to conform said RAM material to at least a portion of said curvatures of said non-planar surfaces.

10. The apparatus of claim 1, wherein the RAM comprises a closed cell synthetic rubber.

11. The apparatus of claim 10, wherein the RAM includes an adhesive backing.

12. The apparatus of claim 11, wherein edges of the RAM are substantially perpendicular to surfaces of the RAM.

13. The apparatus of claim 12 further comprising caulk disposed along edges of the RAM.

14. The apparatus of claim 1, wherein the exterior surfaces of the ears are non-planar and the RAM fixed thereon includes a generally rectangular portion and a generally semi-circular portion.

15. The apparatus of claim 14, wherein the exterior surfaces of the ears include convex portions and the generally semi-circular portion of the RAM includes slots formed therein such that the semi-circular portion of the RAM substantially conforms to the convex portion of the exterior surface of the ear.

16. The apparatus of claim 15, wherein the slots extend from a periphery of the semi-circular portion inwardly along radii of the semi-circular portion.

17. The apparatus of claim 1, wherein the exterior surfaces of the ears include fasteners and the RAM fixed thereon includes notches formed therein at fastener locations.

18. The apparatus of claim 1, wherein the ears include access openings and the RAM fixed thereon includes openings formed therein at access opening locations.

19. The apparatus of claim 1, wherein the RAM that is fixed to exterior surface of the ears comprises one piece of RAM for each ear.

20. The apparatus of claim 1, wherein the RAM is fixed to the neck.

21. The apparatus of claim 20, wherein the RAM that is fixed to the neck is a substantially rectangular piece that includes notches formed therein.

22. The apparatus of claim 1, wherein the RAM is fixed to the base.

23. An apparatus, comprising:

an instrumentation structure including a sensor array and a supporting structure, the sensor array having multi-axis rotatability; and RAM applied to at least one or more exterior surfaces of the instrumentation structure and adapted to reduce electromagnetic radiation reflectivity or detection characteristics including radar visibility of the instrumentation structure, the exterior surfaces of the instrumentation structure including non-planar surfaces and fasteners wherein the RAM is adapted to conform to curvatures of the non-planar surfaces and allow access to the fasteners such that said RAM maintains an approximate smooth surface in areas where said RAM is conformed to said non-planar surfaces;

wherein the supporting structure includes a base and the RAM is fixed to the base;

wherein the RAM that is fixed to the base comprises two substantially rectangular pieces of RAM.

24. An apparatus, comprising:

an instrumentation structure including a sensor array and a supporting structure, the sensor array having multi-axis rotatability; and RAM applied to at least one or more exterior surfaces of the instrumentation structure and adapted to reduce electromagnetic radiation reflectivity or detection characteristics including radar visibility of the instrumentation structure, the exterior surfaces of the instrumentation structure including non-planar surfaces and fasteners wherein the RAM is adapted to conform to curvatures of the non-planar surfaces and allow access to the fasteners such that said RAM maintains an approximate smooth surface in areas where said RAM is conformed to said non-planar surfaces; wherein the supporting structure includes a base, and a tilt support structure that is stationary with respect to rotation of the sensor array around a first axis, and rotates with the sensor array with respect to rotation around a second axis that is perpendicular to the first axis, the RAM being fixed to exterior surfaces of the tilt support structure;

wherein the tilt support structure includes a throat, a neck, and a pair of opposing ears connecting the throat and neck;

wherein the RAM includes RAM fixed to the ears, RAM fixed to the neck, and RAM fixed to the base, the RAM fixed to the ears and the neck being thicker than the RAM fixed to the base.

25. The apparatus of claim 24 wherein a thickness of the RAM fixed to the ears and neck is about 0.25 inches and a thickness of the RAM fixed to the base is about 0.06 inches.

26. A method, comprising:

providing an instrumentation structure including a sensor array and a support structure, the sensor array having multi-axis rotatability; and fixing RAM to at least one or more exterior surfaces of the instrumentation structure and adapted to reduce electromagnetic radiation reflectivity or detection characteristics including radar visibility of the instrumentation structure, the exterior surfaces of the instrumentation structure including non-planar surfaces and fasteners wherein the RAM is adapted to conform to curvatures of the non-planar surfaces and allow access to the fasteners such that said RAM maintains an approximate smooth surface in areas where said RAM is conformed to said non-planar surfaces;

wherein providing the instrumentation structure includes providing an instrumentation structure having a tilt support structure that is stationary with respect to rotation of the sensor array around a first axis, and rotates with the sensor array with respect to rotation around a second axis that is perpendicular to the first axis;

wherein providing a tilt support structure includes providing a tilt support structure having a throat, a neck and a pair of opposing ears connecting the throat and neck;

wherein fixing RAM includes fixing RAM to exterior surfaces of the ears.

27. The method of claim 26, wherein fixing RAM includes fixing RAM having a first and second thickness, said RAM having said first thickness is applied on one part of the instrumentation structure and said RAM having said second thickness is applied on another part of the instrumentation structure.

28. The method of claim 27, wherein fixing RAM includes fixing RAM having a third tapering thickness around service access portions, instrumentation portions and fastener portions of said instrumentation structure.

29. The method of claim 26, further comprising applying a RAM coating to at least one or more areas of said instrumentation structure which does not have said RAM applied thereto.

30. The method of claim 26, further comprising applying a sealing material to at least one or more edge portions of said RAM, said edge portions may include seams in said RAM or discontinuous edges of said RAM material which do not abut another edge of said RAM.

31. The method of claim 30, wherein applying said sealing material includes applying sealing material comprising a multi-layered caulking material which is adapted to be dispensed in a semi-liquid form such that it smoothly conforms to edges of said RAM material and seals edges or seams of said RAM such that said edges or seams are sealed against water or wind slip stream intrusion.

32. The method of claim 31, wherein said multi-layered caulking material has electromagnetic radiation absorptive or deflecting characteristics.

33. The method of claim 26, wherein said RAM thickness is selected based on a plurality of characteristics of said RAM including surface contours of said instrumentation structure including curvature of said instrumentation structure and flexibility of said RAM.

34. The method of claim 26, wherein said RAM comprises a sheet of RAM material wherein one side of said RAM material conformed to at least one portion of said curvatures of said non-planar surfaces comprises one or more slots where RAM material has been removed, said RAM material at said slots are pressed together to conform said RAM material to at least a portion of said curvatures of said non-planar surfaces.

35. The method of claim 26, further comprising applying caulk along edges of the RAM.

36. The method of claim 26, wherein fixing RAM includes fixing RAM comprising a closed cell synthetic rubber.

37. The method of claim 26, wherein fixing RAM includes fixing RAM having an adhesive backing.

38. The method of claim 26, wherein fixing RAM includes providing RAM in sheets and then cutting the RAM using a water jet.

39. The method of claim 26, wherein fixing RAM includes fixing RAM to exterior surfaces of the tilt support structure.

40. The method of claim 26, wherein providing a tilt support structure includes providing a tilt support structure wherein the exterior surfaces of the ears are non-planar.

41. The method of claim 26, wherein providing a tilt support structure includes providing a tilt support structure wherein the ears include fasteners.

42. The method of claim 41, wherein fixing RAM includes forming notches in the RAM at fastener locations.

43. The method of claim 26, wherein fixing RAM includes fixing RAM to a base of the support structure.

44. The method of claim 43 wherein fixing RAM to the base includes fixing two substantially rectangular pieces of RAM to the base.

45. A method, comprising:

providing an instrumentation structure including a sensor array and a support structure, the sensor array having multi-axis rotatability; and fixing RAM to at least one or more exterior surfaces of the instrumentation structure and adapted to reduce electromagnetic radiation reflectivity or detection characteristics including radar visibility of the instrumentation structure, the exterior surfaces of the instrumentation structure including non-planar surfaces and fasteners wherein the RAM is adapted to conform to curvatures of the non-planar surfaces and allow access to the fasteners such that said RAM maintains an approximate smooth surface in areas where said RAM is conformed to said non-planar surfaces; wherein providing the instrumentation structure includes providing an instrumentation structure having a tilt support structure that is stationary with respect to rotation of the sensor array around a first axis, and rotates with the sensor array with respect to rotation around a second axis that is perpendicular to the first axis;

wherein providing a tilt support structure includes providing a tilt support structure;

wherein fixing RAM includes providing RAM comprising a generally rectangular portion and a generally semi-circular portion and forming slots in the RAM such that the RAM substantially conforms to the non-planar exterior surfaces.

46. The method of claim 45, wherein the non-planar exterior surfaces are convex and fixing RAM includes forming slots that extend from a periphery of the RAM inwardly along radii of the semi-circular portion of the RAM.

47. A method, comprising:

providing an instrumentation structure including a sensor array and a support structure, the sensor array having multi-axis rotatability; and fixing RAM to at least one or more exterior surfaces of the instrumentation structure and adapted to reduce electromagnetic radiation reflectivity or detection characteristics including radar visibility of the instrumentation structure, the exterior surfaces of the instrumentation structure including non-planar surfaces and fasteners wherein the RAM is adapted to conform to curvatures of the non-planar surfaces and allow access to the fasteners such that said RAM maintains an approximate smooth surface in areas where said RAM is conformed to said non-planar surfaces;

wherein providing the instrumentation structure includes providing an instrumentation structure having a tilt support structure that is stationary with respect to rotation of the sensor array around a first axis, and rotates with the sensor array with respect to rotation around a second axis that is perpendicular to the first axis;

wherein providing a tilt support structure includes providing a tilt support structure having a throat, a neck and a pair of opposing ears connecting the throat and neck;

wherein fixing RAM includes fixing one piece of RAM to each ear.

48. A method, comprising:

providing an instrumentation structure including a sensor array and a support structure, the sensor array having multi-axis rotatability; and fixing RAM to at least one or more exterior surfaces of the instrumentation structure and adapted to reduce electromagnetic radiation reflectivity or detection characteristics including radar visibility of the instrumentation structure, the exterior surfaces of the instrumentation structure including non-planar surfaces and fasteners wherein the RAM is adapted to conform to curvatures of the non-planar surfaces and allow access to the fasteners such that said RAM maintains an approximate smooth surface in areas where said RAM is conformed to said non-planar surfaces;

wherein providing the instrumentation structure includes providing an instrumentation structure having a tilt support structure that is stationary with respect to rotation of the sensor array around a first axis, and rotates with the sensor array with respect to rotation around a second axis that is perpendicular to the first axis;

wherein providing a tilt support structure includes providing a tilt support structure having a throat, a neck and a pair of opposing ears connecting the throat and neck;

wherein fixing RAM includes fixing RAM to the neck.

49. The method of claim 48, wherein fixing RAM to the neck includes forming notches in a substantially rectangular piece of RAM.

* * * * *